US007448518B2

(12) United States Patent
Yue

(10) Patent No.: US 7,448,518 B2
(45) Date of Patent: Nov. 11, 2008

(54) DISPENSER CAP AND METHOD OF USE

(76) Inventor: Chi Yan Yue, Block A, Unit 10, 5/F., Profit Industrial Bldg., 1-15 Kwai Fung Crescent, N.T., Hong Kong (HK) 852

( * ) Notice: Subject to any disclaimer, the term of this patent is extended or adjusted under 35 U.S.C. 154(b) by 590 days.

(21) Appl. No.: 11/282,471

(22) Filed: Nov. 21, 2005

(65) Prior Publication Data

US 2007/0114251 A1 May 24, 2007

(51) Int. Cl.
*B65D 47/06* (2006.01)

(52) U.S. Cl. ..... 222/500; 222/196.2; 222/196.1

(58) Field of Classification Search ..... 222/500, 222/142.3, 519, 339, 284, 362, 501, 196.1, 222/196.2, 196.5, 189.02, 189.06, 189.08; 292/43, 308; 206/538; 239/664, 650; 137/247.33; 401/200

See application file for complete search history.

(56) References Cited

U.S. PATENT DOCUMENTS 934,493 A * 9/1909 Wolkenstein ..... 222/196.2
1,087,758 A * 2/1914 Goodwin ..... 222/189.07
1,700,350 A * 1/1929 Daniek ..... 222/196.2
1,741,742 A * 12/1929 Skotnik ..... 222/196.2
1,776,395 A * 9/1930 Rundell ..... 222/196.2
2,139,289 A * 12/1938 Skoda ..... 222/196.2
2,256,722 A * 9/1941 Martin ..... 222/500
2,484,148 A 10/1949 Beatty
2,614,732 A * 10/1952 Pararra ..... 222/511
2,762,533 A * 9/1956 Collora ..... 222/196.2
3,057,500 A * 10/1962 Fortuna et al. ..... 215/21
3,682,558 A * 8/1972 Miller ..... 401/200
3,776,433 A 12/1973 Treitas
3,809,275 A * 5/1974 Ek ..... 215/12.1
4,353,487 A 10/1982 Ferrante
5,013,459 A * 5/1991 Gettings et al. ..... 210/764
5,031,675 A 7/1991 Lindgren
5,429,281 A 7/1995 Sellers
7,040,827 B2 * 5/2006 Gueret ..... 401/130
2007/0164060 A1 * 7/2007 Hayday ..... 222/633

* cited by examiner

*Primary Examiner*—Kevin P Shaver
*Assistant Examiner*—Robert K Nichols, II
(74) *Attorney, Agent, or Firm*—Eric Hanscom; Todd Langford

(57) ABSTRACT

The present invention is directed to a dispenser cap that can be placed on a variety of containers holding either dry or liquid products with the capability of either screening the products through a perforated disk or filtering the products through a variety of paper or fabric materials. The filtering materials may be impregnated with substances to enhance liquids when dispensed through the cap. When the dispenser cap is in the vertical position, a central plug seals the container and when the container is tilted or inverted, the product will flow freely.

20 Claims, 4 Drawing Sheets

DISPENSER CAP AND METHOD OF USE

CROSS REFERENCE TO RELATED APPLICATIONS

None.

STATEMENT REGARDING FEDERALLY SPONSORED RESEARCH OR DEVELOPMENT

This invention was not federally sponsored.

FIELD OF THE INVENTION

This invention relates to the field of dispenser caps used on containers that automatically open when the container is tilted and close when the container is in the vertical position and can be put on a variety of different product containers for both dry and liquid substances. More specifically this patent deals with a cap that has varying screening and filtering capabilities with interchangeable filter and screening disks that may easily be disassembled for cleaning.

BACKGROUND OF THE INVENTION

This invention describes a new and unique dispenser cap for both dry and liquid products that can come in a variety of sizes and shapes. Many patents exist for both dry and liquid product dispensers, but none offer the unique capability of screening or filtering the process with a universal cap as well as the patent herein discloses. Additionally when the container is in the upright position the screen or filter element is protected from contamination by the environment by having the device automatically close. Some condiments require that coarse materials be screened out as they are dispensed. Originally the inventor planned his invention for dispensing condiments only with the ability of having a conventional mounting thread that would fit a variety of containers with varying screening capabilities but found that it would work equally as well using a variety of filters for filtering and enhancing liquids.

People have recently become extremely sensitive about the purity of the products that they use. In the past, the sale of individual sizes of bottled water would have been ridiculed, but presently many brands of bottled water sell for more than carbonated beverages. Adding a secondary screening or filtering process to all products ingested is the only way to safeguard against undesirable materials within these products being ingested. New filtering products have recently been released to the market where the filters have been impregnated with a variety of substances to enhance their capabilities. One of these is the addition of vitamin E to the filters used in a showerhead. It is said that the vitamin E helps the skin and additionally purifies the water. A variety of flavored filters can be used to enhance the flavor of water along with adding the secondary filtering process. Additionally, various aromas can be added to the filters for both liquid and dry dispenser caps and users of the invention could purchase filters already impregnated with one or more aromas to further enhance the dispensed substance. Because the filter elements can be removed and replaced easily, the user of the invention has considerable latitude in modifying the substance to be dispensed from the invention.

REFERENCES CITED

U.S. Pat. No. 5,031,675 of Lars Lindgren describes a device for sealing a container to be connected to a recipient provided with a connector for supply of its contents. The intent is to supply a more or less viscous or running material, inclusive of liquid to a recipient via an applied container of some type without any considerable leakage, an example being ink for an ink jet printer. This device offers no screening or filtering capabilities and would not be effectively used with dry products.

U.S. Pat. No. 5,429,281 of Albert E. G. Sellers discloses a shaker for condiments such as salt and pepper having a structure, which provides for the salt or pepper to be discharged by shaking up and down but without reversing the shaker from its vertical storage position. This device, though effective for condiments that are generally dry products, would be incapable of holding liquid products in the upright position without the liquid leaking out the bottom.

U.S. Pat. No. 4,353,487 of Jose Ferrante describes a receptacle for dosifying granulated, pulverulent or liquid products. This device works by having a tapered weighted stopper seated into a tapered orifice and held in place by the means of a coil spring retainer. When inverted and shaken, the weighted stopper allows the contents to be dispensed. Although it states that this device may be used for liquids, it offers no means of screening or filtering the contents of the receptacle.

U.S. Pat. No. 3,776,433 of Elias Martins De Treitas tells of a container such as a vacuum or THERMOS bottle, a dispensing closure including a mouthpiece secured such as by threads in to the neck of the bottle. This device has been designed specifically for liquid products and would not adequately dispense dry products. Although it has a plurality of orifices to dispense the liquids through, it has no means to interchange the filtering capabilities.

U.S. Pat. No. 2,484,148 of Horario E. Beatty tells of a condiment holder, such as are used for salt, pepper and other seasonings. This patent has been designed for condiments only and would not hold liquids or supply a means to filter or screen those products.

None of the foregoing prior art teaches or suggests the particular unique features of the Dispenser Cap disclosed within this patent and thus clarifies the need for further improvements in the devices used to dispense both dry and liquid products.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

SUMMARY OF THE INVENTION

The preferred embodiment of this invention will consist of a dispenser cap that will be available in a variety of sizes and shapes and with a number of different mating thread configurations. The cap consists of a cap ring with a threaded insert, a tapered plug consisting of an upper tapered cover and a central body unit with a shoulder screw that threads into the tapered plug and a filter or screening element. The cap ring will be cylindrically shaped for dispensing products over a broad area and conically shaped with the plug assembly recessed to concentrate the products in a more central location. This invention works by the means of the plug sliding up and down within the cap ring on the shoulder portion of a shoulder screw. An orifice in a filter element is held in place by the shoulder surface and retained by the head of the shoulder screw. The filter element will be retained between the cap ring and the container of the product so when the dispenser cap is screwed in place, the filter element is held tightly. A number of threaded shoulder screws with varying lengths of shoulder surfaces will be available to change the rate of product flow. The filter elements will consist of a circular disk with a central orifice to slide up and down on the shoulder of the shoulder screw and have varying sizes of screening orifices to filter the products that are dispensed. The filtering process of liquids will be accomplished with two similar circular disks with central orifices to slide up and down on the shoulder of the shoulder screw with large orifices on the perimeter. A variety of different filtering materials may be placed between the two disks. Along with being able to filter with different degrees of flow rates and micron reductions, these filters can also be impregnated with a variety of substances to enhance their capabilities such as vitamin E or flavors to enhance the flavor of water or other beverages along with adding the secondary filtering process. Various aromas can also be added to the filters for both liquid and dry dispenser caps and users of the invention could purchase filters already impregnated with one or more aromas to further enhance the dispensed substance. The dispenser cap can easily be disassembled for cleaning or replacement of the filtering material, thereby making modifying the substance to be dispensed from the invention easy, quick, and simple.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

OBJECTS OF THE INVENTION

The principal object of the invention is to create a multipurpose dispenser cap.

Another object of the invention is to create a dispenser cap with a variety of different filter means.

Another object of the invention is to create a dispenser cap that can dispense dry products as well as liquids.

Another object of the invention is to create a dispenser cap with common threads to fit a variety of different containers.

Another object of the invention is to create a dispenser cap that can easily be disassembled for cleaning or replacement of the filtering material.

And still another object of the invention is to create a dispenser cap that will filter with a fabric filter as well as a perforated or screen type of filter.

A further object is to create a dispenser cap that when in the upright position it is sealed and when inverted it flows freely.

An additional object of the invention is to allow for a user to choose from filters manufactured with one or more of the following characteristics: filtering pore size, smell, taste, and type of health-related additive.

A final object of this invention is to add a new and unique device to the area of dry and liquid product dispensers.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
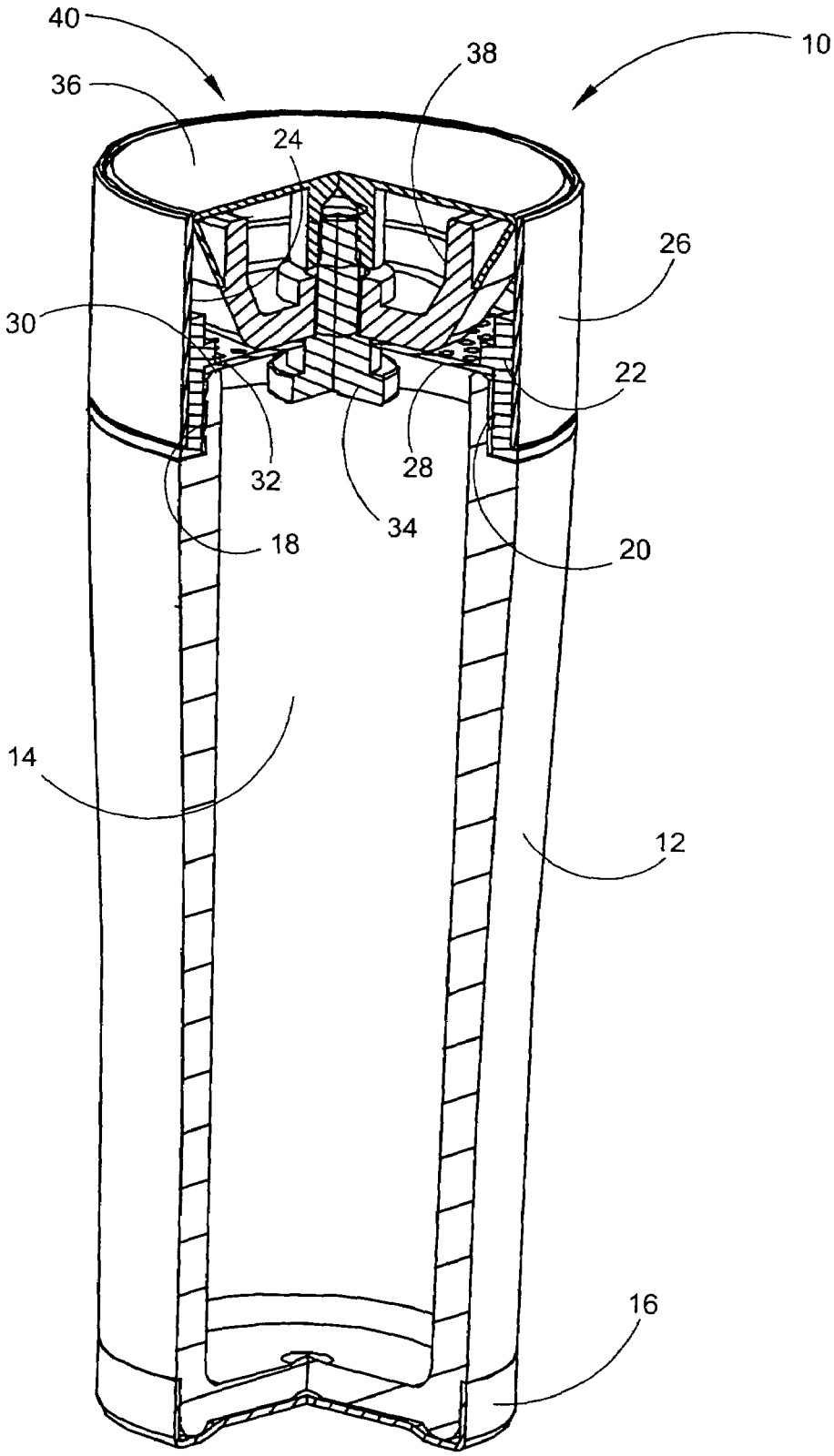
FIG. 1 depicts a perspective view of the dispenser cap on a common container with a quarter section broken away illustrating the internal components.

Referring now to the drawings, wherein similar parts of the dispenser cap 10 are identified by like reference numerals, there is seen in FIG. 1 a perspective view of the dispenser cap 10 on a common container 12 with a quarter section broken away illustrating the internal components. The common container 12 displayed in the drawings is the type normally used for condiments with a central chamber 14 and a decorator ring 16. It must be understood that a variety of both dry product and liquid-product containers can be used with the dispenser cap 10 and will still be covered within the scope of this patent. The threads 18 on the top of the common container 12 will mate with the threads 20 in the threaded insert 22 that is attached to the inner surface 24 of the cylindrical cap ring 26. Dry and liquid filter elements 28 and 28A are rigidly held in place between the top surface 30 of the common container 12 and the shoulder 32 of the threaded insert 22. A shoulder screw 34 threads into the upper tapered cover 36 and the central body unit 38 of the plug assembly 40. The plug assembly 40 depicted as two parts, the tapered cover 36 and the central body unit 38 can just as easily be constructed as a single unit and if so, will still be covered within the scope of this patent.

Figure 2:
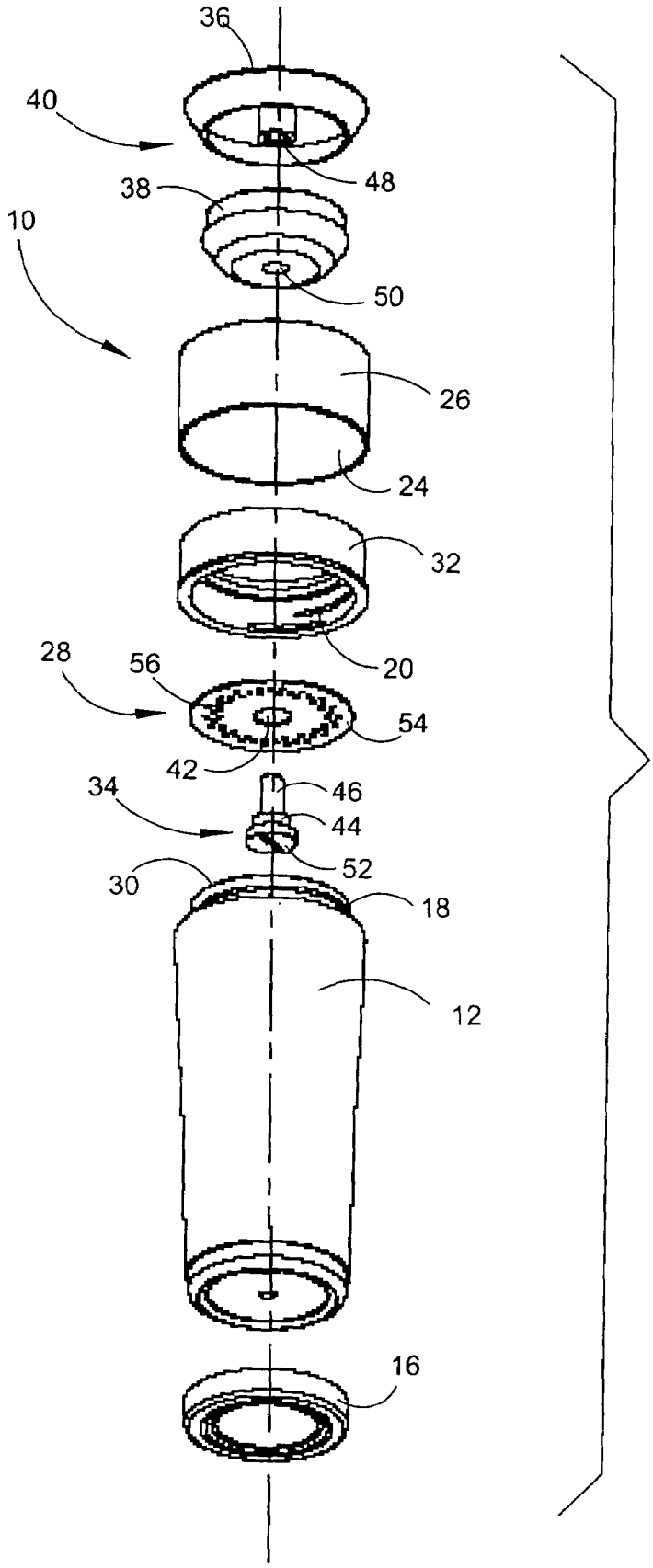
FIG. 2 depicts an exploded view of the dispenser cap and a common container.

The movement of the plug assembly 40 is better defined in FIG. 2 depicting an exploded view of the dispenser cap 10 and a common container 12. The dry filter element 28 that is held rigidly in place between the threaded insert 22 and the container top surface 30 has a central orifice 42 matching the diameter of the shoulder 44 of the shoulder screw 34. With the shoulder screw threads 46 threaded into the threads 48 of the tapered cover 36 and the threads 50 of the central body unit 38, of the plug assembly 40 it allows the plug assembly 40 to move up and down freely while still being retained by the head 52 of the shoulder screw 34 in either the dry or liquid filter elements 28 or 28A.

Figure 3:
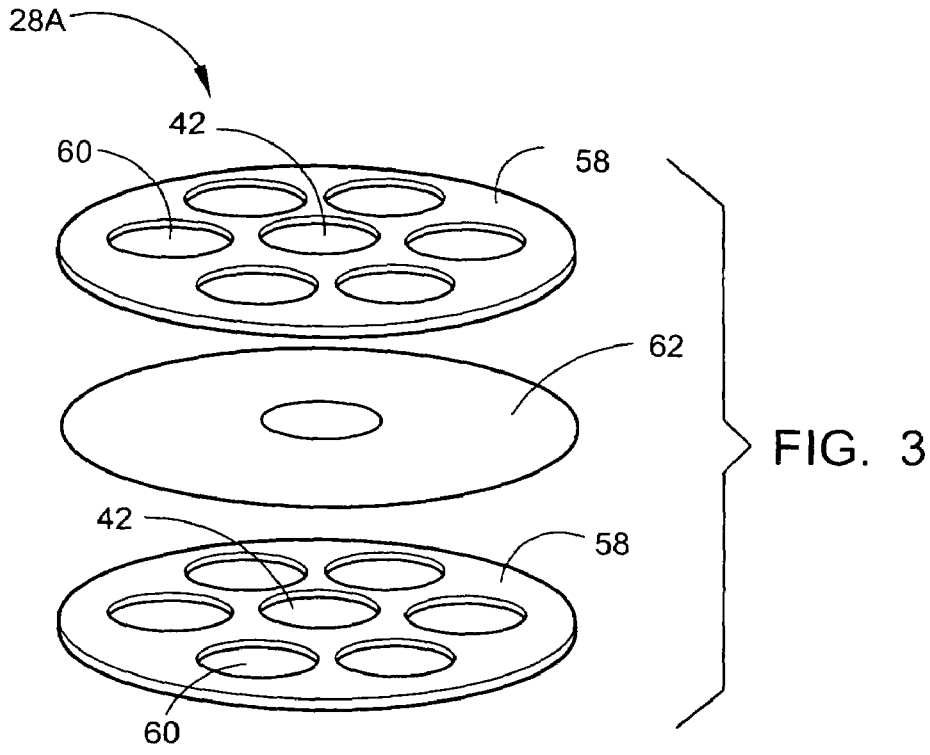
FIG. 3 depicts an exploded view of the liquid filter element using a filter fabric.

The filter element 28 for dry products will consist of a single circular disk 54 with a plurality of screening orifices 56 around the perimeter and the central orifice 42. The liquid filter element 28A, depicted in the exploded view in FIG. 3 will have two circular disks 58 with enlarged orifices 60 around the perimeter and the central orifice 42. Between the two circular disks 58 may be placed a variety of different filter fabrics 62 that may be impregnated with flavor, scent, or other enhancing materials.

Figure 4:
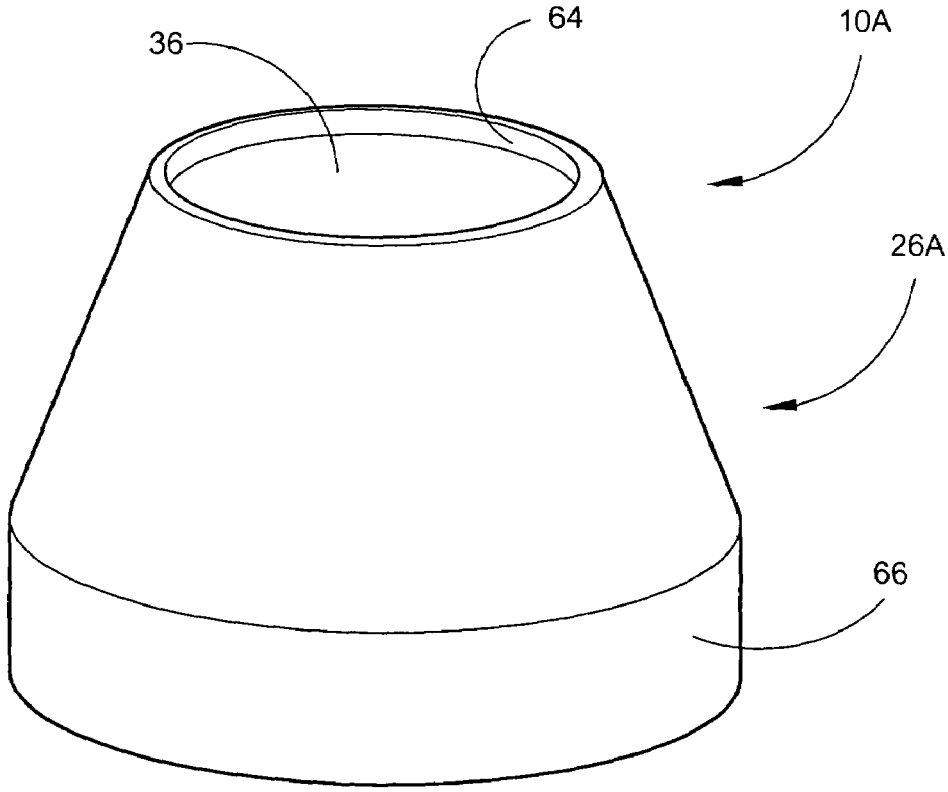
FIG. 4 depicts a perspective view of an alternate embodiment of the dispenser cap with a tapered upper section and the plug assembly recessed.
Figure 5:
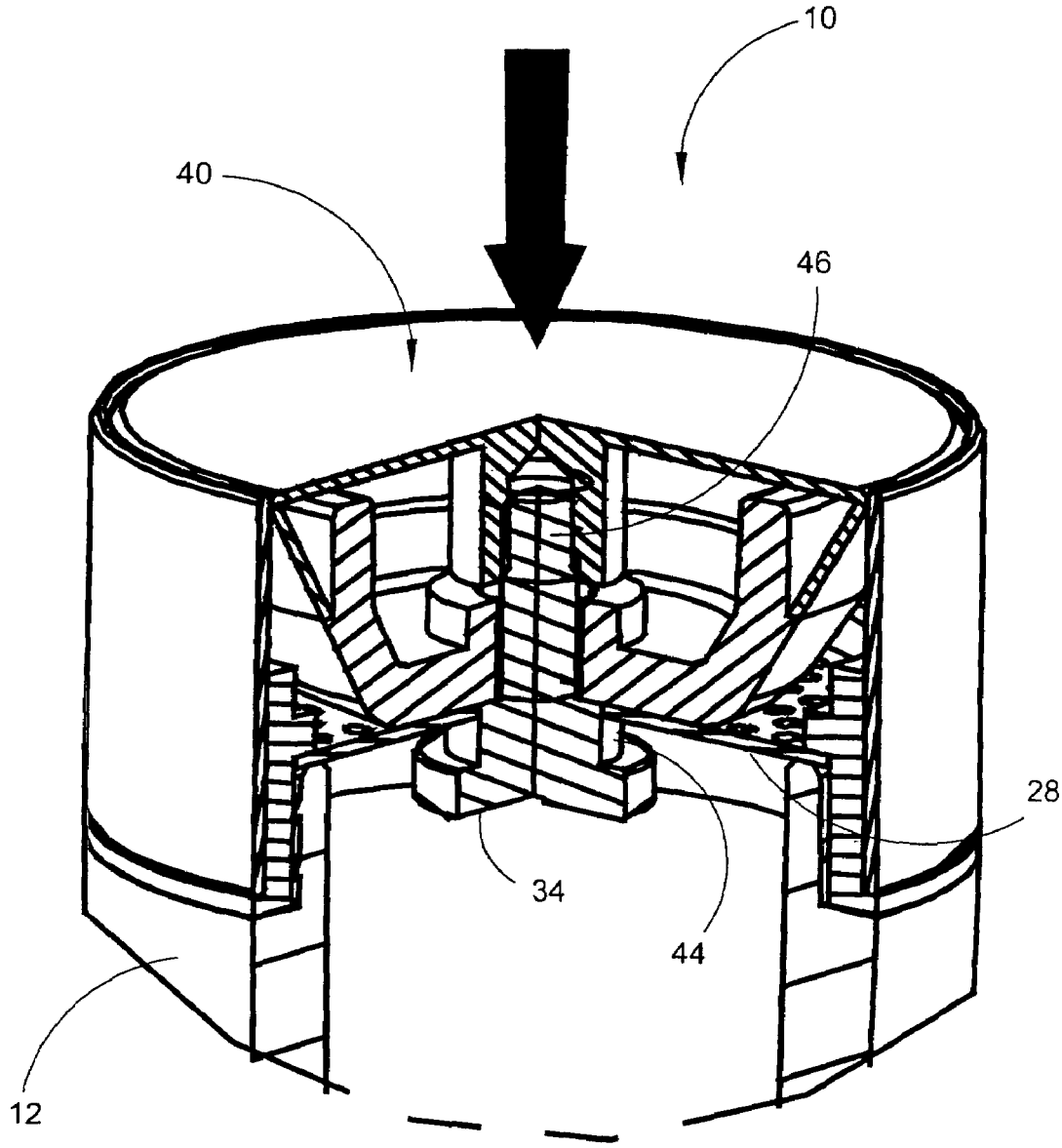
FIG. 5 depicts an enlarged perspective view of the dispenser cap with a quarter section removed.

FIG. 4 depicts a perspective view of an alternate embodiment of the dispenser cap 10A with a tapered cap ring 26A and the plug assembly 40 within a recess 64 to control the liquid flow. The lower section 66 of the tapered cap ring 26A will remain cylindrical to retain the threaded insert 22 and the configuration of the plug assembly 40 will be the same as depicted. FIG. 5 illustrates an enlarged perspective view of the dispenser cap 10 with a quarter section removed illustrating the plug assembly 40 in the sealed position indicated by the directional arrow.

The dispenser caps 10 and 10A shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described may be employed for providing a dispenser caps 10 and 10A in accordance with the spirit of this invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

PARTS LIST

10—Dispenser cap
10A—Dispensor cap
12—Common container
14—Container central chamber
16—Decorator ring
18—Container threads
20—Threaded insert threads
22—Threaded insert
24—Cylindrical cap ring inner surface
26—Cylindrical cap ring
26A—Tapered cap ring
28—Dry filter element
28A—Liquid filter element
30—Container top surface
32—Threaded insert shoulder
34—Shoulder screw
36—Tapered cover
38—Central body unit
40—Plug assembly
42—Central orifice
44—Shoulder of the shoulder screw
46—Shoulder screw threads
48—Tapered cover threads
50—Central body unit threads
52—Shoulder screw head
54—Single circular disk
56—Screening orifices
58—Circular disk
60—Enlarged orifice
62—Filter fabric
64—Recess
66—Cap ring lower section

I claim:

1. A multi-purpose dispensing cap, comprising:

a plug assembly, comprising, a tapered cover comprising a circular flat top with one or more perforations though a substance can flow, tapered sides, and a threaded section under the center of the circular flat top, a central body unit comprising an upper diameter which fits inside of the tapered cover, a tapered section, and a central orifice with threads, and, a shoulder screw which has an upper threaded portion which mates with the threaded portions of the tapered cover and the central body unit, a centrally located shoulder section, and a lower head of shoulder screw section, where, the upper threaded portion of the shoulder screw, when threaded into the threaded portions of the tapered cover and central body unit, forms a single unit for the purposes of movement, a cylindrical cap ring which comprises a cylindrical tube of a diameter that is slightly larger than the tapered sides of the tapered cover, such that the tapered cover can slide into and out of the inner circumference of the cylindrical cap ring, a threaded insert shoulder which comprises a cylindrical section of a diameter slightly smaller than the diameter of the cylindrical cap ring, such that the cylindrical cap ring can slide over the cylindrical section of the shoulder, an outer seating section which has a diameter equal to the diameter of the cylindrical cap ring, such that the cylindrical cap ring can slide down the cylindrical section of the shoulder but comes a rest when reaching the outer seating section of the shoulder, an inner threaded portion and at shoulder portion, a means of attachment between the cylindrical cap ring and the threaded insert shoulder such as snaps, such that the cylindrical cap ring does not accidentally detach from the threaded insert shoulder at undesired times, and yet can be detached by the user when the user cleans the invention, a common container defined by a cylindrical tube on its sides, a closed bottom, a container top which has a diameter slightly less than that of the cylindrical tube, a threaded portion along the outside of the container top, and a container top surface which is flat, circular, and at the top of the threaded portion, where, the threads on the inside of the threaded insert shoulder mate with the threaded portion along the outside of the container top, and, a filter device, comprising a central orifice of a diameter slightly larger than the upper threaded portion, such that the shoulder screw can slide through the central orifice of the filter device, but of a diameter smaller than the shoulder portion of the shoulder screw, and an outer diameter equal to the diameter of the container top surface and slightly less than the diameter of the shoulder portion of the threaded insert shoulder, such that when the shoulder screw is screwed into the threaded portions of the tapered cover and central body unit, the filter device is affixed above the shoulder portion of the shoulder screw and below the shoulder portion of the threaded insert shoulder, where, when the dispenser cap is in the upright position it is sealed as the plug assembly lies flush with the top of the cylindrical cap ring, and when the dispenser cap is inverted it flows freely as the plug assembly slides down to the point where the shoulder portion of the shoulder screw meets the central orifice of the filter device.

2. The device of claim 1, where, the filter device is a dry filter device comprising a least one single, circular disk of filter fabric with a plurality of screening orifices around the perimeter and a central orifice.

3. The device of claim 1, where the more filter device is a wet filter device comprising at least two circular disks with a central orifice and a plurality of enlarged orifices around its perimeter, and at least one circular disk of filter fabric with a central orifice.

4. The device of claim 1, where the more filter device comprises at least two circular disks, each with a central orifice and at least one filtering orifice, at least one filter element, with a central orifice, which is located in between the at least two circular disks, where, the at least two circular disks and at least one filter element can slide up and down on shoulder screw and are of a diameter large enough to rest on the shoulder member of the dispensing cap, where, the at least one filter element can be impregnated with a one or more substances, such as vitamins, aromas or flavors, which are dissolved or otherwise added to the substance as it is dispensed.

5. The device of claim 1, where the filter device comprises at least one filter fabric which has one or more screening orifices which either slow the flow of the substance through the filter or filter out larger particles of the substance.

6. The device of claim 1, where the filter device comprises at least one filter fabric which is impregnated with a flavor which is dissolved or otherwise added to the substance as it is dispensed.

7. The device of claim 1, where the filter device comprises at least one filter fabric which is impregnated with a scent which is dissolved or otherwise added to the substance as it is dispensed.

8. The device of claim 1, where the filter device comprises at least one filter fabric which is impregnated with a vitamin which is dissolved or otherwise added to the substance as it is dispensed.

9. The device of claim 1, where the filter device comprises at least one filter fabric which is impregnated with another health-related or sense-related additive which is dissolved or otherwise added to the substance as it is dispensed.

10. The device of claim 1, where the filter device comprises at least one filter which can have two or more impregnated substances, those substances including at least one of the following types of substances: flavors, scents, vitamins, other health-related substance, and other sense-related substance.

11. The device of claim 1, where the filter device comprises at least one filter which is impregnated with a flavor and at least one filter which is impregnated with a vitamin.

12. The device of claim 1, where the filter device comprises at least one filter fabric where the filter fabric is impregnated with a time-release substance.

13. The device of claim 1, where the filter device comprises at least one dry filter element and at least one liquid filter element.

14. The device of claim 1, where the filter device comprises at least one fabric filter and one perforated or screen type of filter.

15. The device of claim 1, where the dispenser cap can easily be disassembled for cleaning or replacement of the filtering material.

16. The device of claim 1, where the dispenser cap has filter elements for both dry and liquid substances such that the dispenser cap can be used with containers filled with both dry and liquid substances without needing to change the filter elements.

17. The device of claim 1, where the common container additionally comprises a decorator ring.

18. The device of claim 1, where the threaded portion of the threaded insert shoulder are common threads to fit a variety of common containers.

19. A method of dispensing a substance, comprising the steps of:

first, taking a dispenser cap comprising:

a plug assembly, comprising, a tapered cover comprising a circular flat top with one or more perforations though a substance can flow, tapered sides, and a threaded section under the center of the circular flat top, a central body unit comprising an upper diameter which fits inside of the tapered cover, a tapered section, and a central orifice with threads, and, a shoulder screw which has an upper threaded portion which mates with the threaded portions of the tapered cover and the central body unit, a centrally located shoulder section, and a lower head of shoulder screw section, where, the upper threaded portion of the shoulder screw, when threaded into the threaded portions of the tapered cover and central body unit, forms a single unit for the purposes of movement, a cylindrical cap ring which comprises a cylindrical tube of a diameter that is slightly larger than the tapered sides of the tapered cover, such that the tapered cover can slide into and out of the inner circumference of the cylindrical cap ring, a threaded insert shoulder which comprises a cylindrical section of a diameter slightly smaller than the diameter of the cylindrical cap ring, such that the cylindrical cap ring can slide over the cylindrical section of the shoulder, an outer seating section which has a diameter equal to the diameter of the cylindrical cap ring, such that the cylindrical cap ring can slide down the cylindrical section of the shoulder but comes at rest when reaching the outer seating section of the shoulder, an inner threaded portion and a shoulder portion, a means of attachment between the cylindrical cap ring and the threaded insert shoulder such as snaps, such that the cylindrical cap ring does not accidentally detach from the threaded insert shoulder at undesired times, and yet can be detached by the user when the user cleans the invention, a common container defined by a cylindrical tube on its sides, a closed bottom, a container top which has a diameter slightly less than that of the cylindrical tube, a threaded portion along the outside of the container top, and a container top surface which is flat, circular, and at the top of the threaded portion, where, the threads on the inside of the threaded insert shoulder mate with the threaded portion along the outside of the container top, and, a filter device, comprising a central orifice of a diameter slightly larger than the upper threaded portion, such that the shoulder screw can slide through the central orifice of the filter device, but of a diameter smaller than the shoulder portion of the shoulder screw, and an outer diameter equal to the diameter of the container top surface and slightly less than the diameter of the shoulder portion of the threaded insert shoulder, such that when the shoulder screw is screwed into the threaded portions of the tapered cover and central body unit, the filter device is affixed above the shoulder portion of the shoulder screw and below the shoulder portion of the threaded insert shoulder, where, when the dispenser cap is in the upright position it is sealed as the plug assembly lies flush with the top of the cylindrical cap ring, and when the dispenser cap is inverted it flows freely as the plug assembly slides down to the point where the shoulder portion of the shoulder screw meets the central orifice of the filter device, second, filling a common container with a dry substance, third, attaching the dispensing cap to the common container, fourth, inverting the common container with attached dispensing cap over an object, such as food, upon which the substance inside the common container is desired, and, fifth, when the desired amount of substance from the common container is deposited on the object, returning the device to its upright position.

20. A method of dispensing a substance, comprising the steps of:

first, taking a dispenser cap comprising:

a plug assembly, comprising, a tapered cover comprising a circular flat top with one or more perforations though a substance can flow, tapered sides, and a threaded section under the center of the circular flat top, a central body unit comprising an upper diameter which fits inside of the tapered cover, a tapered section, and a central orifice with threads, and, a shoulder screw which has an upper threaded portion which mates with the threaded portions of the tapered cover and the central body unit, a centrally located shoulder section, and a lower head of shoulder screw section, where, the upper threaded portion of the shoulder screw, when threaded into the threaded portions of the tapered cover and central body unit, forms a single unit for the purposes of movement, a cylindrical cap ring which comprises a cylindrical tube of a diameter that is slightly larger than the tapered sides of the tapered cover, such that the tapered cover can slide into and out of the inner circumference of the cylindrical cap ring, a threaded insert shoulder which comprises a cylindrical section of a diameter slightly smaller than the diameter of the cylindrical cap ring, such that the cylindrical cap ring can slide over the cylindrical section of the shoulder, an outer seating section which has a diameter equal to the diameter of the cylindrical cap ring, such that the cylindrical cap ring can slide down the cylindrical section of the shoulder but comes at rest when reaching the outer seating section of the shoulder, an inner threaded portion and a shoulder portion, a means of attachment between the cylindrical cap ring and the threaded insert shoulder such as snaps, such that the cylindrical cap ring does not accidentally detach from the threaded insert shoulder at undesired times, and yet can be detached by the user when the user cleans the invention, a common container defined by a cylindrical tube on its sides, a closed bottom, a container top which has a diameter slightly less than that of the cylindrical tube, a threaded portion along the outside of the container top, and a container top surface which is flat, circular, and at the top of the threaded portion, where, the threads on the inside of the threaded insert shoulder mate with the threaded portion along the outside of the container top, and, a filter device, comprising a central orifice of a diameter slightly larger than the upper threaded portion, such that the shoulder screw can slide through the central orifice of the filter device, but of a diameter smaller than the shoulder portion of the shoulder screw, and an outer diameter equal to the diameter of the container top surface and slightly less than the diameter of the shoulder portion of the threaded insert shoulder, such that when the shoulder screw is screwed into the threaded portions of the tapered cover and central body unit, the filter device is affixed above the shoulder portion of the shoulder screw and below the shoulder portion of the threaded insert shoulder, where, when the dispenser cap is in the upright position it is sealed as the plug assembly lies flush with the top of the cylindrical cap ring, and when the dispenser cap is inverted it flows freely as the plug assembly slides down to the point where the shoulder portion of the shoulder screw meets the central orifice of the filter device, second, filling a common container with a liquid substance, third, attaching the dispensing cap to the common container, fourth, inverting the common container with attached dispensing cap over an object, such as food, upon which the substance inside the common container is desired, and, fifth, when the desired amount of substance from the common container is deposited on the object, returning the device to its upright position.

* * * * *